US010220241B2

(12) United States Patent
Strickland

(10) Patent No.: US 10,220,241 B2
(45) Date of Patent: Mar. 5, 2019

(54) GLUTEUS MAXIMUS POWER LIFT APPARATUS

(71) Applicant: Kenneth Dwayne Strickland, Canyon Country, CA (US)

(72) Inventor: Kenneth Dwayne Strickland, Canyon Country, CA (US)

( * ) Notice: Subject to any disclaimer, the term of this patent is extended or adjusted under 35 U.S.C. 154(b) by 0 days.

(21) Appl. No.: 15/436,867

(22) Filed: Apr. 28, 2017

(65) Prior Publication Data

US 2017/0291057 A1 Oct. 12, 2017

Related U.S. Application Data

(60) Provisional application No. 62/297,398, filed on Feb. 19, 2016.

(51) Int. Cl.
*A63B 21/00* (2006.01)
*A63B 23/04* (2006.01)
(Continued)

(52) U.S. Cl.
CPC ..... *A63B 21/063* (2015.10); *A63B 21/0628* (2015.10); *A63B 21/154* (2013.01);
(Continued)

(58) Field of Classification Search
CPC ..... A63B 21/00058; A63B 21/00065; A63B 21/00069; A63B 21/00072; A63B 21/00076; A63B 21/00178; A63B 21/00185; A63B 21/002; A63B 21/0023; A63B 21/062; A63B 21/0622; A63B 21/0624; A63B 21/0626; A63B 21/0628; A63B 21/063; A63B 21/0632; A63B 21/065; A63B 21/068; A63B 21/08; A63B 21/15; A63B 21/151; A63B 21/154; A63B 21/159; A63B 21/4011; A63B 21/4015; A63B 21/4017; A63B 21/4019; A63B 21/4027; A63B 21/4029; A63B 21/4031; A63B 21/4033; A63B 21/4034; A63B 21/4035; A63B 21/4039; A63B 21/4045;
(Continued)

(56) References Cited

U.S. PATENT DOCUMENTS 4,577,861 A * 3/1986 Bangerter ..... A63B 23/03533 482/100
4,625,959 A * 12/1986 Schleffendorf ..... A63B 21/155 482/100
(Continued)

*Primary Examiner* — Gary D Urbiel Goldner
(74) *Attorney, Agent, or Firm* — Mu P.C.

(57) ABSTRACT

The gluteal muscles are exercised using a vertical lift strategy. It is much improved over common buttock exercise methods of sitting, laying, squatting or pushing weight horizontally. The (GM) power lift apparatus is operated in a standing position. Using commercial exercise design methods, the GM power lift apparatus is designed around the lifting of a variable weight plate stack. Three pullies redirect the pull force of the weight plate under the operator's foot as lift on the gluteus maximus muscle group. The new standing design allows improved muscle agitation by making the gluteus maximus muscle group lift a vertical payload, the maximum angle of force. During the power lift stroke, the foot, leg and back muscles are vertically synchronized to horizontal stretched forearms providing greater strength management.

15 Claims, 7 Drawing Sheets

(51) Int. Cl.
*A63B 69/00* (2006.01)
*A63B 21/062* (2006.01)

(52) U.S. Cl.
CPC ..... *A63B 21/4013* (2015.10); *A63B 21/4015* (2015.10); *A63B 21/4034* (2015.10); *A63B 23/0405* (2013.01); *A63B 21/4035* (2015.10); *A63B 69/0057* (2013.01); *A63B 2208/0204* (2013.01); *A63B 2209/10* (2013.01); *A63B 2225/09* (2013.01)

(58) Field of Classification Search
CPC ..... A63B 23/035; A63B 23/03508; A63B 23/03516; A63B 23/03525; A63B 23/04; A63B 23/0405; A63B 23/0482; A63B 69/0057; A63B 69/0059; A63B 2069/0062; A63B 2208/02; A63B 2208/0204; A63B 2208/0209; A63B 2225/09; A63B 2225/093
See application file for complete search history.

(56) References Cited

U.S. PATENT DOCUMENTS 5,423,730 A * 6/1995 Hirsch ..... A63B 21/06 482/904
6,394,935 B1 * 5/2002 Lake ..... A63B 21/154 482/93
6,592,502 B1 * 7/2003 Phillips ..... A61H 1/0214 482/121
6,702,724 B2 * 3/2004 Taylor ..... A63B 23/0405 482/101
7,871,360 B1 * 1/2011 Hoole ..... A63B 23/12 482/121
7,918,770 B1 * 4/2011 Hoole ..... A63B 23/03525 482/105
8,147,389 B1 * 4/2012 Hoole ..... A63B 23/1227 482/100
2005/0043150 A1 * 2/2005 Nitta ..... A63B 21/026 482/79
2008/0287270 A1 * 11/2008 Carter ..... A63B 21/154 482/99
2011/0028870 A1 * 2/2011 Greenburg ..... A63B 21/062 601/27
2013/0040787 A1 * 2/2013 Giannelli ..... A63B 21/062 482/97
2013/0130866 A1 * 5/2013 Wehrell ..... A63B 21/1403 482/5
2014/0171273 A1 * 6/2014 Rapp ..... A63B 21/062 482/102
2014/0296037 A1 * 10/2014 Razzaq ..... A63B 21/16 482/54
2016/0166871 A1 * 6/2016 Kamins ..... A63B 21/0442 482/124
2016/0346590 A1 * 12/2016 Giannelli ..... A63B 21/063

* cited by examiner

GLUTEUS MAXIMUS POWER LIFT APPARATUS

CROSS REFERENCE TO PRIOR APPLICATION

The current application claims the benefit of U.S. Provisional Application No. 62/297,398 entitled GLUTEUS MAXIMUS POWER LIFT APPARATUS, filed on Feb. 19, 2016.

BACKGROUND OF INVENTION

The most significant contribution to the creation of the Gluteus Maximus power lift apparatus is the popularity in commercial exercise equipment. More and more people are demanding excellent health benefits to include more exercise. Current apparatuses for exercising the gluteal group of muscles are awkward and have a minimum effect. Little has been done to cure the problem until now. Specific groups of people who cannot tolerate the awkward positions of the body may find a better experience if they are standing up. Older, still active adults, blood pressure sensitive and heart persons benefit greatly if their medical disabilities are not agitated.

BRIEF SUMMARY OF INVENTION

The Gluteus maximus (GM) power lift apparatus provides a simple way to exercise the gluteal muscle group comprised of the gluteus maximus, the gluteus medius and the gluteal minimus. Current methods of exercising these muscles are awkward requiring the greatest of discipline to achieve better results. Older adults living an active lifestyle generally do not have the physical capacity for the bending, stooping or head down operations that can agitate their disabilities. Conditions like high blood pressure, heart conditions or symptoms of dizziness, nausea and other temporary problems are routinely caused by these poorly designed exercise machines.

The (GM) power lift apparatus is a commercial grade machine formed from steel, aluminum, and a few composites of plastic and rubber. As an exercise machine the (GM) power lift uses a selected weight system and pulleys to deliver a lift payload to the exerciser underneath the heel of the foot. The operator steps onto the platform, sets the handgrips in their tubes for height and distance. Operator then selects the amount of weight to lift and sets the lock pin in the selected weight plater of choice. To secure the operator's foot, the operator kneels briefly to fasten both foot and ankle straps with buckle. With handgrips, weight selection and foot strap safety features engaged the exerciser starts the lift stoke by contracting the gluteus maximus to raise the leg as high as possible. On the down stroke, the operator slowly lowers the leg back to a standing position and the power lift stroke begins again. To assist in maintaining a standing position the handgrips are used as the pivot of counter balance to stabilize body motion generated by the lift forces. When the operator is ready to exercise the other leg, the operator turns the foot assembly 180 degrees in the other direction and repeats the prepping to lift exercise the other Gluteus maximus muscle.

DETAILED DESCRIPTION OF THE INVENTION

Figure 1:
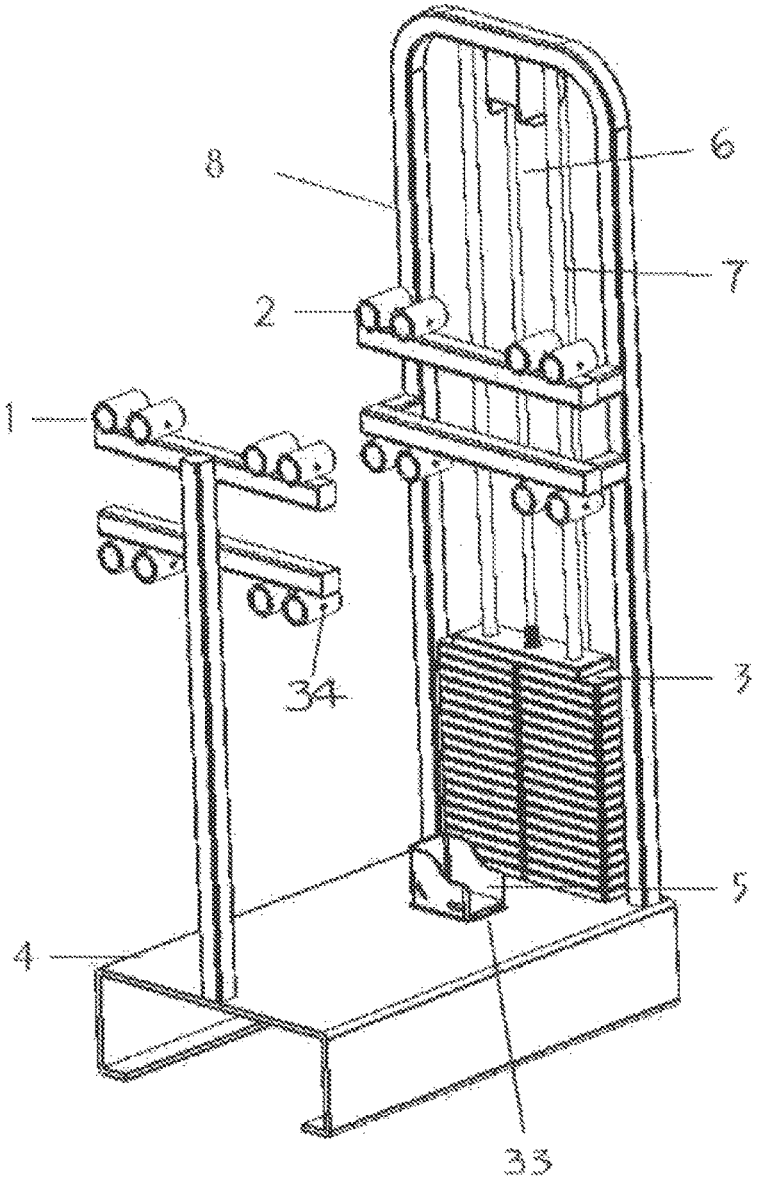
FIG. 1. Rendering of the Gluteus Maximus power lift apparatus in 3D showing the simple design features.

The Gluteus Maximus Power Lift Apparatus FIG. 1 is designed from standard steel stock materials used in commercial exercise equipment. The manufacture of this product is well suited for welding. The cylindrical tube arrays 1 and 2, the vertical steel rods 7 and square bars usage 8 creates the frame for the apparatus. The apparatus has a step-up platform 4 to allow for parts assembled underneath. The weight plate system 3 is a standard assembly used in a selected weight system. The foot assembly 5 is formed from a mold. Of cast aluminum, the foot assembly 5 is a single piece critical in the delivery of lift power to the operator. Steel cable encapsulated in vinyl 6 is standard usage in the motion of the weights. There are a few specialized rubber 33 or rubber like substances on surfaces to absorb the bumping metal parts.

The (GM) power lift apparatus FIG. 1 distinguishes itself from all other gluteal and buttock methods of exercise performing a vertical lift on the gluteus maximus muscle while in a normal standing position. Other methods of delivering exercise to these areas are less effective as bending, stooping and laying down seem contrary to the lift potential of the gluteal group.

Figure 6:
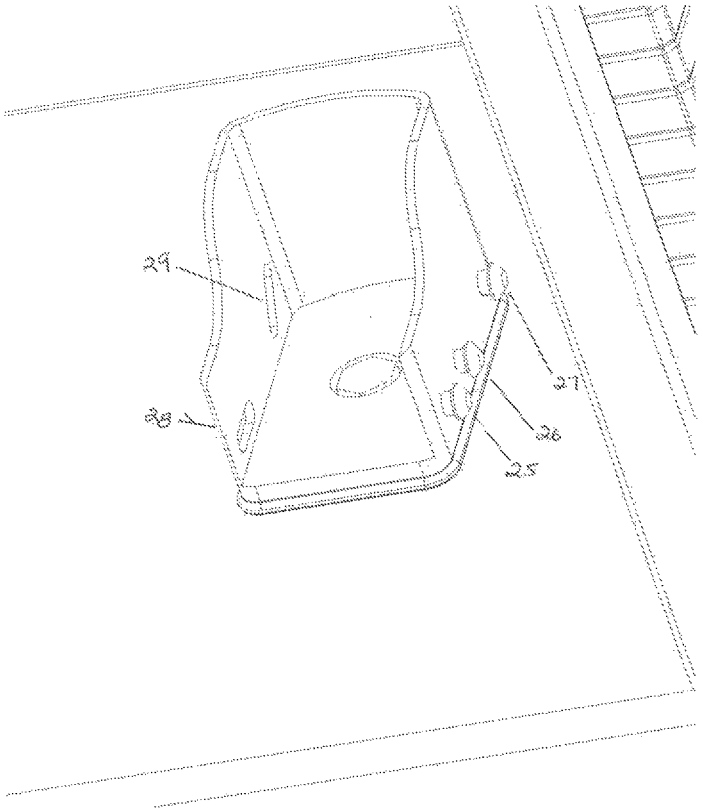
FIG. 6. The foot assembly is critical to the power lift stroke of this apparatus that maintains secure footing during operation.

The tube arrays 1, 2 are functional and ornamental enabling a varied selection of height and distance to secure the operator's limbs during the power lift. This feature keeps both arms and hands flexed to balance the various stresses inherent in weight lifting. As the focal point of counter balance, the array tubes mount hand grips, FIG. 6, 30 inside the tubes with a pin lock FIG. 6, 31 that fits into synced holes. The hand grips mount in up or down positions to cover a region that the operator may need to get a good grip. There is a tube array for each hand. Operator selects a position on the tube array FIG. 1, 1 pushing the hand grip FIG. 6 into a tube and secure it with the pin lock FIG. 6, 31 provided on each grip.

Figure 2:
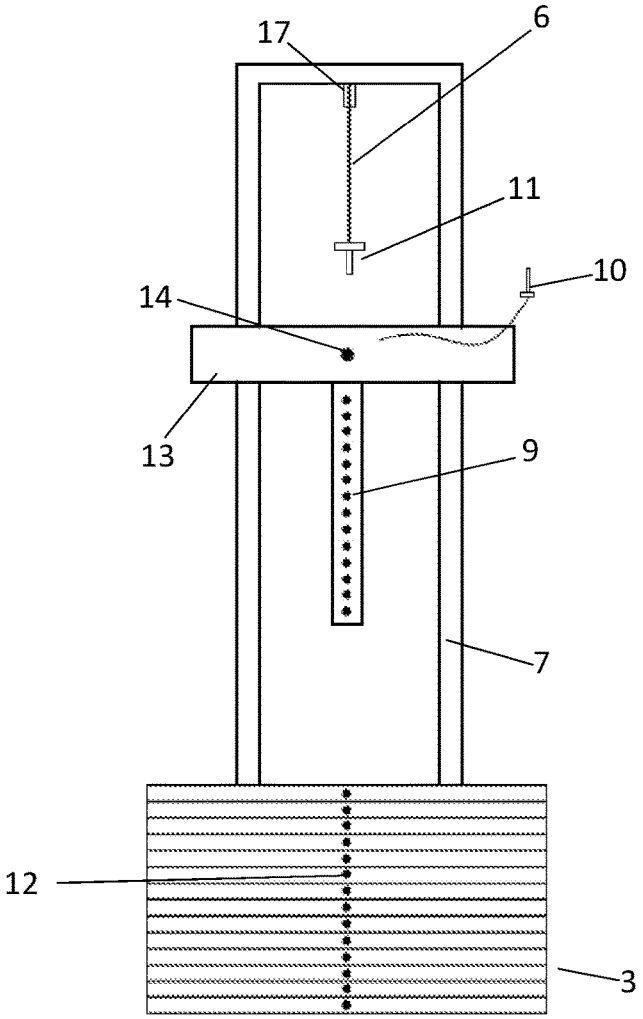
FIG. 2. Cross section view of how the weight platter system is constructed and what is used to select the and use the weight plates.

A standard exercise design, the weight plate system FIG. 2 is traditional to include two symmetrical vertical slide bars 7, a center attached cable 6 secured with a holed sleeve 9. With weight plate 13 lifted, the holed sleeve 9 is installed underneath and aligned with first sleeve hole. A plug 14 with threads is screwed into the weight plate 13 on the select side where there is a threaded hole 12, locks the holed sleeve to the weight plate 3 and to the motion of the vertical steel bars 7. Next a cable fastener screw/nut 11 is screwed into the top of the holed sleeve poking out and nut is screwed down to lock the cable 6 to the weight plate 13, the holed sleeve 9 and the cable pulley system 6.

The weight plates 3 are labeled by weight increase 12 so the operator can set various weight loads. By pushing a metal pin lock 10 thru the weight plate selected 12 the corresponding holed sleeve 9 is locked as well. When the operator begins the power lift stroke all the weight plates above the pin lock 10 become part of the lifting activity. With these components working together the operator can focus on a safe and fruitful exercise.

Figure 3:
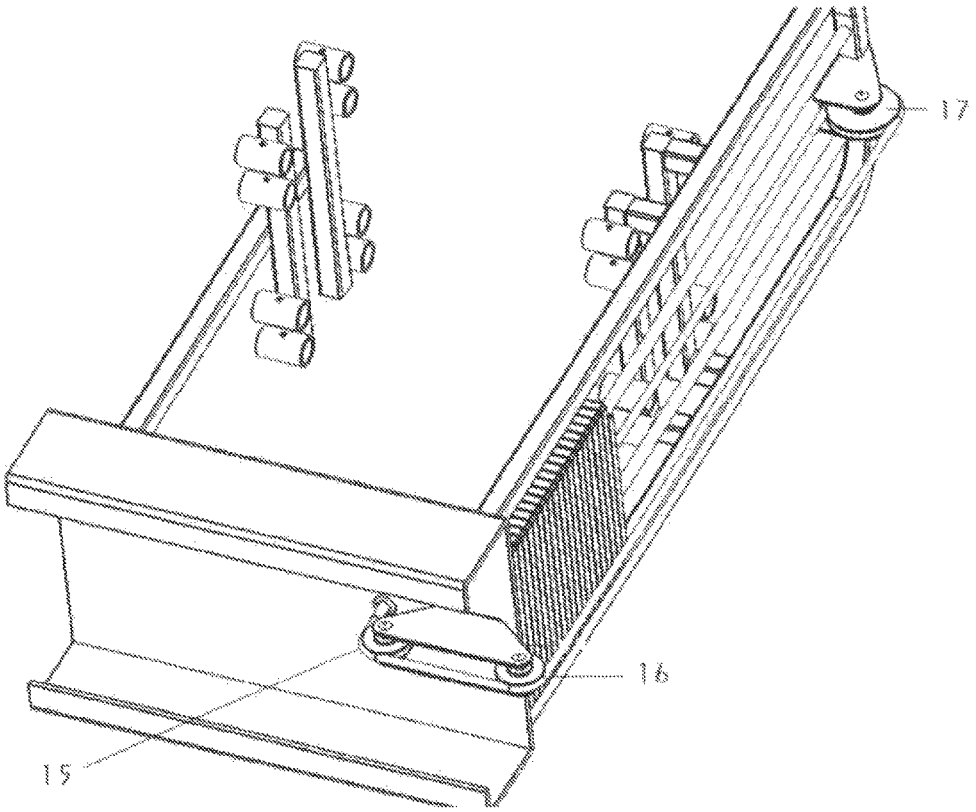
FIG. 3. Rendered 3d view of the pulley system shows how the design delivers a power lift potential to the foot assembly from the weight plate system.

The (GM) power lift apparatus has a system of pulleys FIG. 3 to redirect the forces of lift from the foot assembly to the selected weight platter. Pulley A 15 and pulley B 16 are positioned underneath apparatus platform 4 directly where the cable 6 comes through the platform to connect to the foot assembly. When demanded Pulley A 15 turns the cable 90 degrees from a vertical force to a horizontal force. Thereafter a second pulley, B 16 positioned partially away and free of the platform 4 turns the cable force direction upward toward the upper frame of the apparatus. Pulley Cm 17 positioned in the upper frame is both aligned with the center of the weight platter system 3 and the vertical cable 6 from pulley B 16. Pulley C 17 facilitates a 180 degree direction change in the lift force such that the lift force is now directly on the selected weights 12. With the lift force initiated by the Gluteal muscles and transferred from the foot assembly 5 connection to the cable system 6 redirected by pulley A 15 and pulley B 16 to pulley C 17, the cable system 6 of the (GM) power lift apparatus lifts the selected weight plates 12 so a payload selected by the operator creates a lift exercise.

Figure 4:
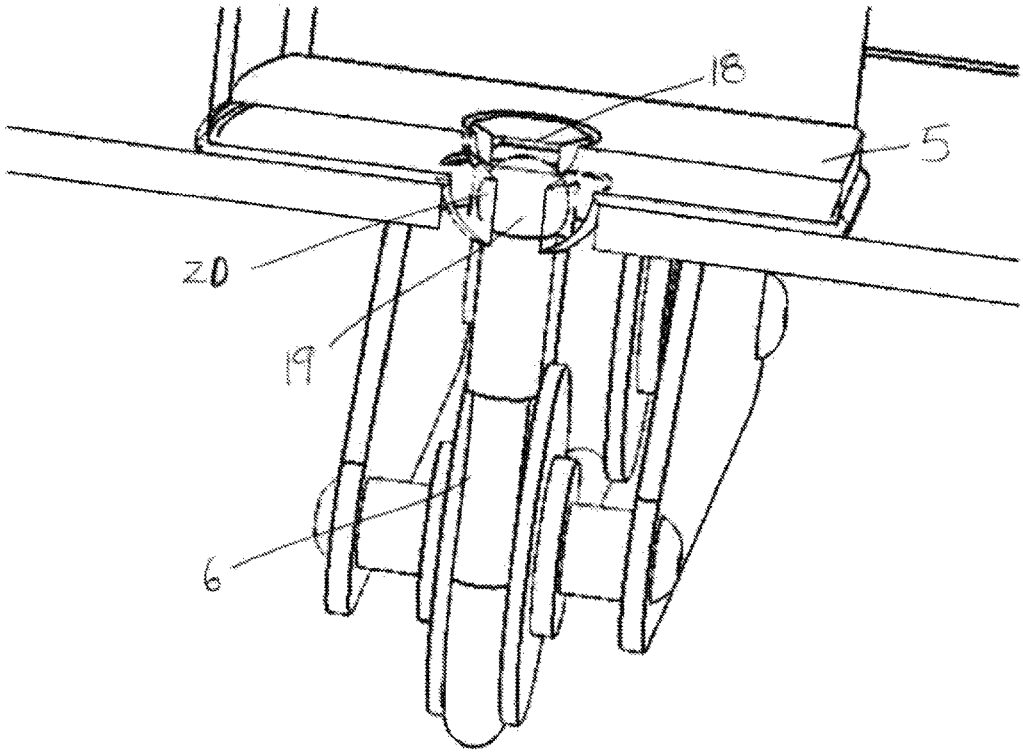
FIG. 4. Displays the uncomplicated design of the foot assembly and how it attaches to the cable system and secures the foot.

The foot assembly FIG. 4 is a critical part of the gluteus maximus power lift apparatus. It is a single piece of aluminum or lighter metal formed by mold. On the bottom heel area is a protrusion that is a partial sphere 20. Two different size holes are drilled in this bump, from above and below. The hole below is suited for threading cable wire 6 thru it. The above drilled hole is larger than the hole below. When the cable 6 is pulled thru from the top side to the side below. At the end of the cable wire 6, one side of it has a metal knot 19 which is larger than the hole for the cable. That stops the cable 6 from going all the way out. At that point the foot assembly 5 is connected to the cable system 6. There is just enough room left for a small screw cap 18 over the cable notch 19 to protect the users from any injuries.

Figure 5:
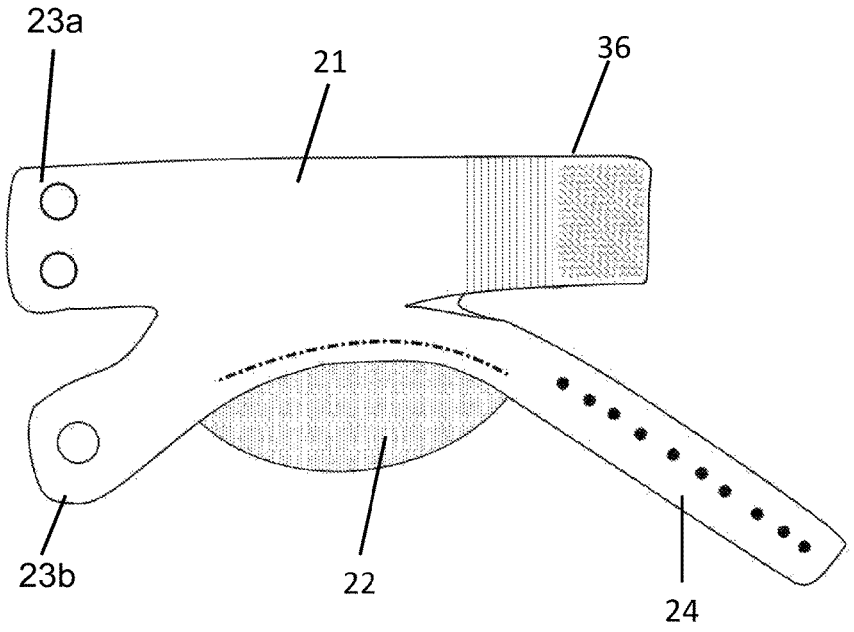
FIG. 5. The foot strap buckle is a varied design of Velcro and stud fasteners secured to the apparatus' foot assembly.

More pressure and stress is on the foot assembly FIG. 5 than any other place on the body. To protect the foot, a foot strap of different layers of manufactured materials keep the foot safe; kevlar creates the outer structure 21. Underneath and sewn onto the kevlar is two inches of memory foam 22 in direct contact with the operator's footwear and ankle. Studs 23*a*, 23*b* secure the foot strap to the side of foot assembly FIGS. 5 and 6, 25, 26, 27. The strap is placed over the foot. Placing the foot strap over the foot, the operator must loop the front strap through the loophole FIGS. 5 and 6, 28 designated to secure the mid toe and ball of foot and Velcro the reversed flap down 36. The ankle flap 24 pulls back and down and is looped through FIGS. 5 and 6, 29 to secure the ankle and heel. With that the operator is free to enjoy exercising the gluteal using the power lift.

FIG. 6 is the foot assembly that secures the foot so that the lifting of weight will be injury free. Studs 25, 26, 27 are used to secure the foot strap to the foot assembly. Loops 28 and 29 are used by the Kevlar and Velcro straps to secure the foot.

Figure 7:
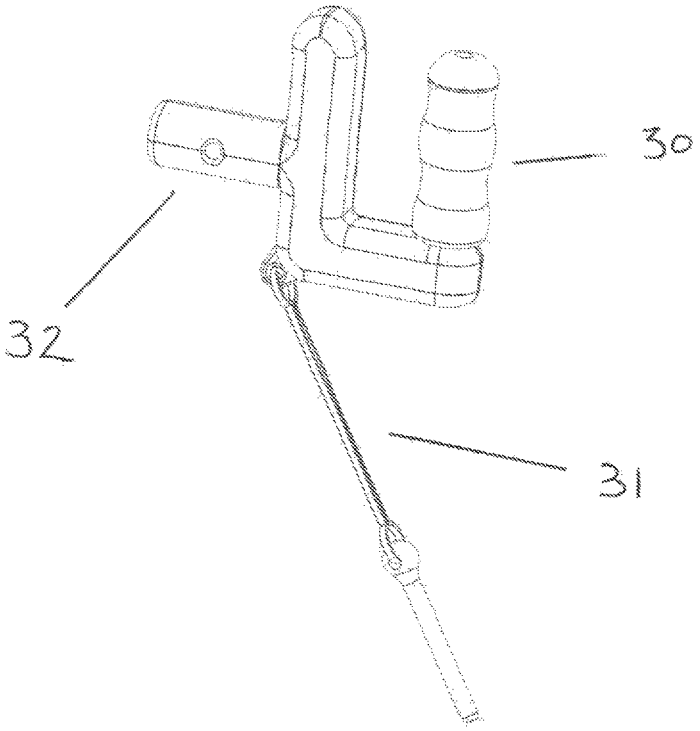
FIG. 7. Two hand grips are used to stabilized the vertical and horizontal motions during the operation of this apparatus.

When an exerciser is ready to operate the gluteus maximus powerlift apparatus, the hand grips FIG. 7 must be adjusted to the operators arm and forearm lengths. There are two hand grips which are pushed into the tubes arrays of FIG. 1. The hand grips are secured with lock pin 31. An exerciser should then stand center on the platform FIG. 1, 4 facing so the hands are nearest the tube arrays on both sides of the body. While your arms are hanging down, raise your forearm to a horizontal level. This is the ideal height and distance of the arm for counter balance. Note the position of your hand where it is closest to a tube in the tube array FIG. 1. If your forearm is below the lowest tubes horizontal, slide the hand grip in the tube upside down at that position. If the forearm is above the lower horizontal tubes slide the hand right-side up in the tube. Exerciser must perform this procedure for the other arm too.

With all prep activities completed, the operator is ready to enjoy exercising the gluteal muscles.

The Gluteus Maximus Power Lift Apparatus is constructed to provide a repetitive vertical lift exercise stroke on the gluteal muscles from a standing position using hand grips for a counter balance.

The Gluteus Maximus Power Lift Apparatus is designed to deliver a repetitive vertical lift exercise stroke on the gluteal muscles from weight attached to a cable underneath the heel of a foot assembly designed to immobilized the operator's foot.

The invention claimed is:

1. A power lift apparatus comprising:

a. a platform provided to accommodate a user;

b. a frame assembly extending upward from the platform;

c. a weight system having a plurality of weight plates in communication with the frame assembly;

d. a foot assembly in communication with the weight system and provided on top of the platform, the foot assembly configured to receive a foot of the user;

e. a first tube array provided on the frame assembly;

f. a second tube array extending from the platform opposite of the first tube array;

g. one or more hand grips having a protrusion configured to be received by the first tube array or the second tube array, wherein the foot assembly engages the weight system, wherein upward movement of the foot assembly is transferred through a plurality of pulleys to the weight system via a cable, wherein at least one pulley of the plurality of pulleys is disposed directly underneath the foot assembly, and wherein the weight system provides a selective resistance against the upward movement of the foot assembly.

2. The apparatus of claim 1, wherein the selective resistance is selected by engaging a predetermined number of the plurality of weight plates.

3. The apparatus of claim 1, wherein the foot assembly comprises a foot basket having of a recess configured to accept an end of the cable, the foot assembly further comprising a foot strap configured to secure the user's foot to the foot basket.

4. The apparatus of claim 3, wherein the foot assembly is comprised of a single piece aluminum cast.

5. The apparatus of claim 1, wherein the first tube array is comprised of 8 tubes configured to respectively receive the one or more hand grips, and wherein the second tube array is comprised of 8 tubes configured to respectively receive the one or more hand grips.

6. The apparatus of claim 5, wherein the one or more hand grips further comprise a lock pin.

7. The apparatus of claim 1, wherein the plurality of pulleys consists of three pulleys.

8. A power lift apparatus, comprising:

a platform;

a weight plate having a holed sleeve;

a frame assembly extending from the platform;

a weight system having a stacked set of weights, each weight from the stacked set of weights having a hole, slideably disposed along the frame assembly, a subset from the stacked set of weights being configurable in connection with engagement of a lock pin through the holed sleeve with the hole of a selected weight;

a plurality of pulleys;

a cable, disposed around the plurality of pulleys, being removably attached to the weight plate;

a foot assembly connected to the cable, the subset of the stacked set of weights presenting a counter weight to motion of the cable around the plurality of pulleys;

a first tube array disposed on the frame assembly;

a second tube array disposed on a distal end of the platform away from the frame assembly, the first tube array and the second tube array configured to define defining an area on the platform for a user of the power lift apparatus; and one or more hand grips disposed in the first and second tube array.

9. The power lift apparatus of claim 8, wherein the first tube array and the second tube array are comprised of a plurality of cylindrical tubes.

10. The apparatus of claim 9, wherein the plurality of cylindrical tubes are provided in parallel with the platform.

11. The apparatus of claim 8, wherein the foot assembly comprises a foot basket having a recess configured to accept an end of the cable, the foot assembly further comprising a foot strap configured to secure a foot of the user to the foot basket.

12. The apparatus of claim 11, wherein the foot basket is comprised of a single piece aluminum cast.

13. The apparatus of claim 8, wherein the first tube array is comprised of 8 cylindrical tubes configured to respectively receive the one or more hand grips, and wherein the second tube array is comprised of 8 cylindrical tubes configured to respectively receive the one or more hand grips.

14. The apparatus of claim 8, wherein the plurality of pulleys consists of three pulleys.

15. The apparatus of claim 8, wherein the one or more hand grips further comprise a second lock pin.

* * * * *